United States Patent [19]

Fahrner

[11] Patent Number: 4,947,778

[45] Date of Patent: Aug. 14, 1990

[54] BARGE CONNECTING APPARATUS

[76] Inventor: Willard F. Fahrner, 2255 Holly Oaks River Dr., Jacksonville, Fla. 32211

[21] Appl. No.: 294,002

[22] Filed: Jan. 6, 1989

[51] Int. Cl.[5] ..... B63B 21/62

[52] U.S. Cl. ..... 114/248; 114/250

[58] Field of Search ..... 114/242, 248–252, 114/77 R

[56] References Cited

U.S. PATENT DOCUMENTS

| | | | |
|---|---|---|---|
| 3,257,986 | 6/1966 | Glosten | 114/250 |
| 3,494,318 | 2/1970 | Katsumura | 114/248 X |
| 3,802,375 | 4/1974 | Janssen | 114/251 X |
| 3,820,258 | 6/1974 | Fahrner | 37/58 |
| 3,973,512 | 8/1976 | Fahrner | 37/58 |
| 4,023,518 | 5/1977 | Fahrner | 114/244 |

*Primary Examiner*—Sherman D. Basinger

*Attorney, Agent, or Firm*—Penrose Lucas Albright

[57] ABSTRACT

An apparatus for interconnecting a pair of barges, or other waterborne vessels, to facilitate hookup and release of barges in an "on-hip" arrangement with a powered vessel. Oriented on the bow of each barge, coincident with the barge's longitudinal center line, is a bracket terminating in a socket. A pivot shaft with an upper ball adapted to fit in the socket is provided with a lower trunion to support a bridge element whereby two barges may be connected. The bridge element is free to rotate in a horizontal plane about the pivot shafts to allow swinging movement of the barges and the ball-in-socket fitting allows a limited range of independent movement for the barges such as in swells. Movement limiting fenders and chains are provided to control swing of the barges. Such an apparatus allows a single tug or dredge to rapidly make up a dual barge push towing arrangement.

23 Claims, 7 Drawing Sheets

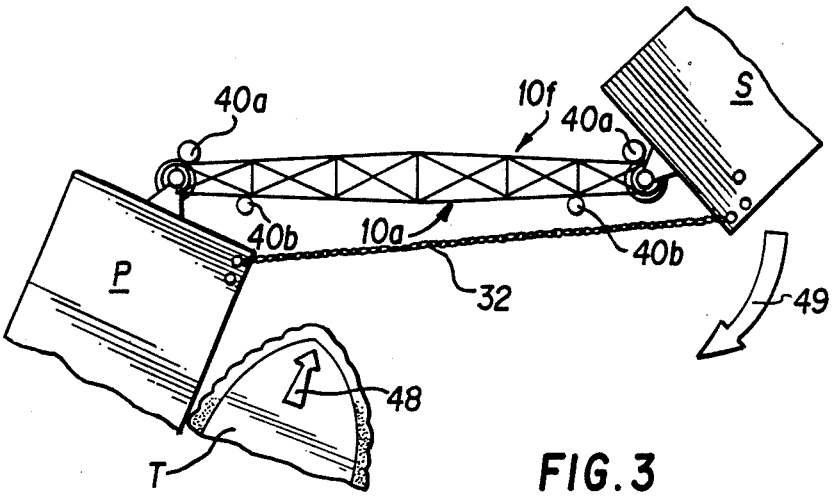
FIG. 3
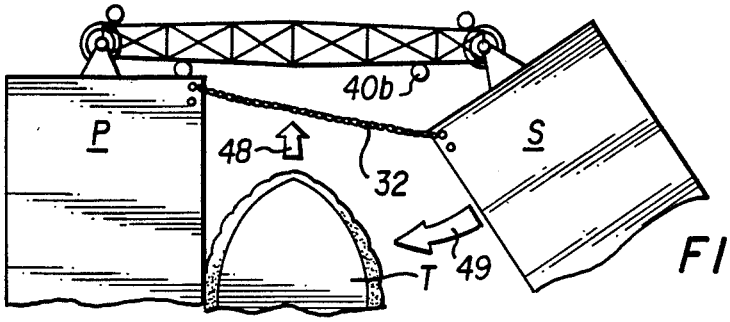
FIG. 4
FIG. 5
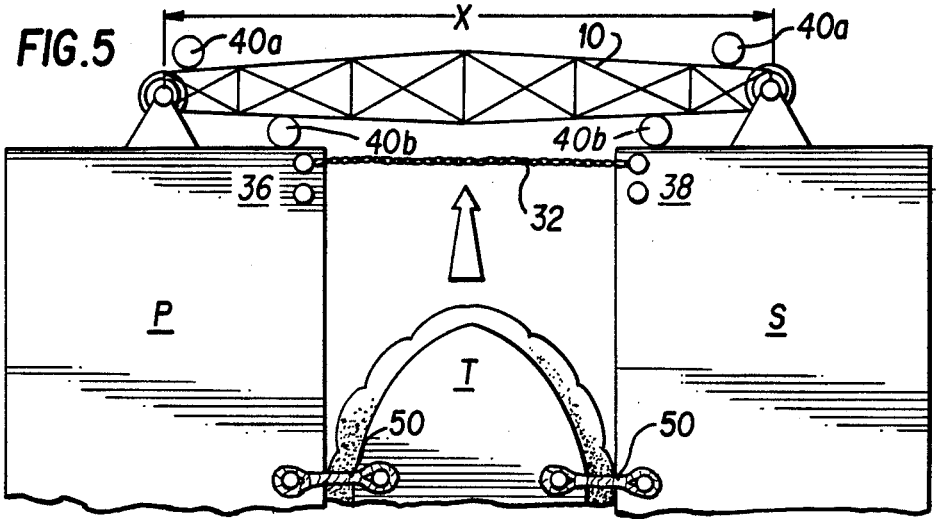

BARGE CONNECTING APPARATUS

BACKGROUND OF THE INVENTION

This invention relates to a new and efficient means of interconnecting a dual barge tow for use in transportation or dredging, that maintains a substantially parallel orientation of the barge's keels to an axis parallel to the propelling vessel's propeller axis to maximize the vessel's propulsive efficiency. Two barges are interconnected at their bow by a bridge element which maintains the spacing of the barges' longitudinal axes while allowing a limited range of pivotal movement to greatly facilitate the makeup and release of the parallel barge/-tug arrangement.

When the dual barge arrangement is employed in combination with a center drag arm dredge, the pivotal interconnection of the barge's bows greatly facilitates dredging operations by simplifying the makeup and release of the barge/dredge module for transportation of loaded barges to a dump site.

Currently, trailing suction hopper dredging is perhaps the most viable and used method in the dredging industry. Advantages of this dredging mode are well known, especially to those who create and enforce environmental controls for dredge-spoil disposal operations. The total operation is commonly known as 'dredge and haul'. As popular as trailing suction hopper dredges have become, they have a significant disadvantage in that their dredge-spoils retention hoppers are too small. Even the largest and most costly of these dredging ships fills its hoppers with retained dredge-spoils in one hour or less. When the hoppers are full, the dredger must stop dredging operations, leave the dredging site, transport dredge-spoils to the disposal site, upon arrival at the disposal site, dump or pump the dredge-spoils from the retention hoppers in a manner that meets all ecological requirements, and then return to the dredging site to repeat the cycle.

Transport and disposal of hopper-retained dredge-spoil has become the dominant consideration in today's harbor channel maintenance dredging and deepening projects as most involve removal of polluted or otherwise noxious dredge-spoils which must be transported to distant disposal sites and there dumped or pumped into special confinements. The interruption of dredging operations posed by the transport and disposal phases of "dredge and haul" operations has become extremely significant. Additionally, special dredge-spoil confinements, designed to protect the environment, make offloading of dredge-spoils from the dredge ship's retention hoppers difficult.

Depending upon the distance between the dredging site and the dump site, the ratio of transport and disposal time to actual dredging time varies, but the average breakdown suggests the ratio is about nine to one; that is nine hours in the transport and disposal phase for every hour in the dredging phase. Thus an expensive, highly specialized dredging ship with an equally expensive and specialized compliment of officers and crew spend nine of every ten hours doing tasks common to all shipping and not requiring the expensive specialization. This break in operations roughly equates to shutting down a factory for nine out of ten hours, while keeping all power on and all employees at their stations. In one important aspect, however, it is worse. A factory resumes operations at the point where it stopped, but the resumption of dredging will be imperfectly prosecuted after the break in dredging operations. The dredge ship cannot return to the range and station at which the last cut was terminated with precision; the tide and currents will have changed and the entire range of dredging parameters which were established via continual observations, monitoring and control of the variables, such as tide, current, position, has been lost due to the nine hour interruption. This inefficiency, the lost dredging time and the discontinuity of dredging, is an inherent result of existing trailing suction hopper dredges having intregal hoppers.

In spite of these great costs due to intrinsic operational inefficiencies, which in all probability will increase with the passage of time, the need for dredging operations will continue to expand to support the increasing requirements of ship traffic in and adjacent to harbors and inland waterways worldwide. This is particularly so due to the substantial increases in the draft and carrying capacity of merchant vessels over the last several years.

Although a growing awareness concerning marine and shoreside ecological considerations has served to emphasize the economic problems of the present hopper dredge operations, the fact is that a need has long existed for a system which is more efficient than that used at present to excavate and dispose of the dredged material.

It is not necessary that trailing suction hopper dredges have internal dredge-spoils retention hoppers. Rather, they can be a composite system consisting of dredge ship to which an endless series of separable hopper units are sequentially supplied, thereby creating a quick-change composite dredging system with potentially infinite hopper capacity. This system retains the dredge ship at the dredging site on a nearly continuous basis while the hopper units and their motive power, such as a tug, transport and dispose of the dredge-spoils.

U.S. Pat. Nos. 3,820,258; 3,973,512; and 4,023,518 disclose systems comprising a dredging ship and abutted, connected barges that were joined using stern notches in the barges and cushioned bows on the trailing ship or barge. However, that system, employing vessels of a special configuration and requiring complex elements for joining and separating the vessels, has proved too costly in construction to provide a practical alternative to the current methods of transporting the dredged material internal to the dredging ship.

Further, when using notched barges for transporting the dredged material, the problems inherent in tug movement of the barges are encountered if the tug, used to transport the barges to and from the disposal site, is not provided with the bow cushions as disclosed in U.S. Pat. No. 3,973,512. Without bow cushions, the tug may use a method of alongside towing known as tandem towing. In tandem towing, the propelling vessel has one barge on each hip, the total wetted surface of such an arrangement is symmetrical and coincident with the longitudinal axis of the propeller. If a single barge alongside arrangement is employed, the propeller axis is offset to the side of the wetted surface's longitudinal axis. Such an arrangement is said to "carry rudder" because the propeller tends to drive the arrangement in a circle, and the powered vessel, the tug or dredge, must use the rudder to compensate. The use of the rudder to compensate limits the amount of rudder available for steering. This unbalanced situation results in an undesirable loss of maneuverability and is particularly notable when attempting to make up the tandem towing arrangement. After hookup of the first barge, the maneuverability of the propelling tug or dredge is so limited that a second tug is often required to make up the dual barge arrangement.

SUMMARY OF THE INVENTION

The present invention features the modality of the notched barge system, via a special arrangement using many off-the-shelf items, while providing a simple means of creating a tandem, or multiple barge, tow. Instead of the specially configured and fendered bows and notched sterns required for bow-in-stern-notch association between dredger and hipper units, a side-by-side dual-barge hopper unit is created. The port and starboard barge members, comprising the hopper units are adjoined at their bows via a specially configured bridge which maintains the bow-separation between the barges and yet permits the port and starboard barge-bows to pivot around the port and starboard bridge-end connections. Thus the two inboard sides of two ordinary, rectangular barges form an entry notch of discrete width at their bows and a notch of adjustable width at their sterns thereby forming a hopper unit with which a dredger (particularly a center-well, center-drag arm dredger), or transporting vessel, may quickly and safely associate via known means. In spite of the simple apparatus, the association between the dredger and the parallel barges of the hopper unit can be made as rigid as desired by cinching with port and starboard stern lines and the resultant extensive lateral and vertical frictional interface created between the vessel, either the dredger or transport tug, and the parallel dual-barge hopper unit.

The barge connection structure of the present invention extends between the bows of two barges, or similar powerless waterborne vessels, to allow a single tug or dredge quickly and easily to make-up to the tandem barge arrangement while simultaneously orienting the barges in a parallel alongside arrangement to the tug or dredge. When a tug or dredge makes-up an "on hip" arrangement with one of the barges and imposes headway, the second barge will tend to swing into a parallel orientation due to the pivotal connection of the barges' bows by the bridge element. Further, to escape the barge duo, such as during the transfer of a barge duo from a dredge to a tug for transportation to a dump site, the dredge merely has to cast off from one of the barges, impose sternway, thereby spreading the barges, cast off from the second barge and back out. The tug, or other powered vessel for moving the barges to the dumpsite, can then make up to the inboard side of one barge, impose headway properly to orient the barges in the desired dual alongside arrangement, and then make-up to the second barge thereby completing the "tandem tow".

Thus, the present invention is directed to a new connective means for the port and starboard elements of a dual, tandem, barge hopper unit to permit their service as:

(1) dredge-spoil retention hopper units when associated with the dredger; and
(2) dredge-spoil transport vessels when associated with and powered by another vessel such as a tug.

Further, the dredge-spoil disposal vessels may be specially configured and/or engineered to fulfill requirements imposed by a specific project disposal site and/or disposal method. They also may be designed for high speed tow operations, during transport, and are subject to less regulation because they are unmanned.

Further objects, adaptabilities and capabilities will be understood by those skilled in the art from the following description of the invention, reference being had to the accompanying drawings:

BRIEF DESCRIPTION OF THE DRAWINGS

FIG. 3 is a schematic, partly broken view of a tug making up a "tandem tow" by imparting headway to a pair of barges connected by the apparatus of the present invention;

FIG. 4 is a schematic, partly broken view of a tug making up to a pair of barges connected by the apparatus of the present invention;

FIG. 5 is a plan, partly broken view of a dual barge arrangement connected by the apparatus of the present invention fully made up into a tow;

DESCRIPTION OF THE PREFERRED EMBODIMENTS

The barge connecting apparatus of the present invention is employed to provide orientation of the bow of a pair of barges to maintain them a predetermined distance apart while allowing the barges a limited range of movement in a horizontal plane and further allowing the barges a limited range of independent movement about the point of attachment at the barges' bows. The barges' bows are thus oriented a predetermined distance apart by the connecting apparatus while allowing a range of independent movement of their sterns as a result of pivoting about their points of attachment at the barges' bows.

Figure 12:
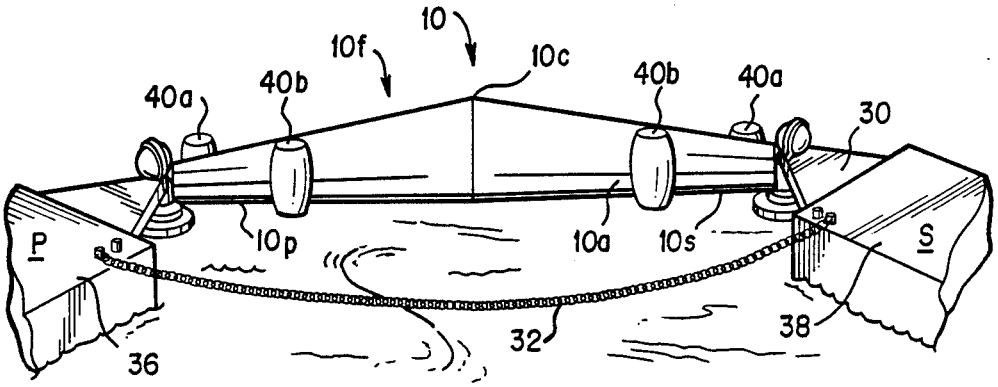
FIG. 12 is a perspective, partly broken view of a second embodiment of the barge connection apparatus.
Figure 13:
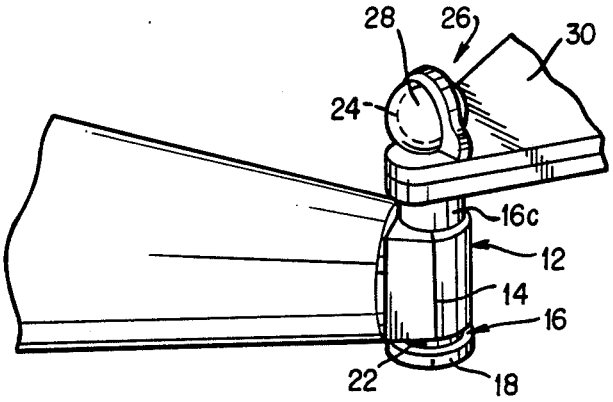
FIG. 13 is an enlarged perspective, partly broken view of the pivot arm connection used with the bridge element of FIG. 12.

The apparatus of the present invention includes a bridge element 10 which is adapted to interconnect a starboard barge S and a port barge P. The bridge element 10 is preferably a truss structure tapered from its center 10*c* to its ends 10*p*, 10*s* and has a length X (FIG. 5) approximately totalling the beam of tug T plus the beam of one of the barges. Thus the separation between the inboard bow portions of the barges is approximately equal to the beam of the dredger or tug making-up to them. Bridge element 10 may be of a triangulated box girder construction as shown in FIGS. 1–9 or of a tubular beam construction, FIGS. 12 and 13, which is tapered from the center to the end so that the port and starboard halves comprise elongated conical structures rigidly connected at the center. Mounted to bridge element 10 adjacent each end are fenders 40 which will be more fully described below.

Terminal ends 10*p* and 10*s* of bridge element 10 each have an identical vertically oriented fitting, designated generally by reference number 12, which is adapted to receive a tubular bearing insert (not shown). Fitting 12 and the bearing insert are preferably split, as along a seam 14 to permit the seating of a vertical cylindrical pivot arm 16 therein. Upon seating of pivot arm 16 therein, seam 14 is sealed by welding, bolting, or other suitable means.

Figure 1:
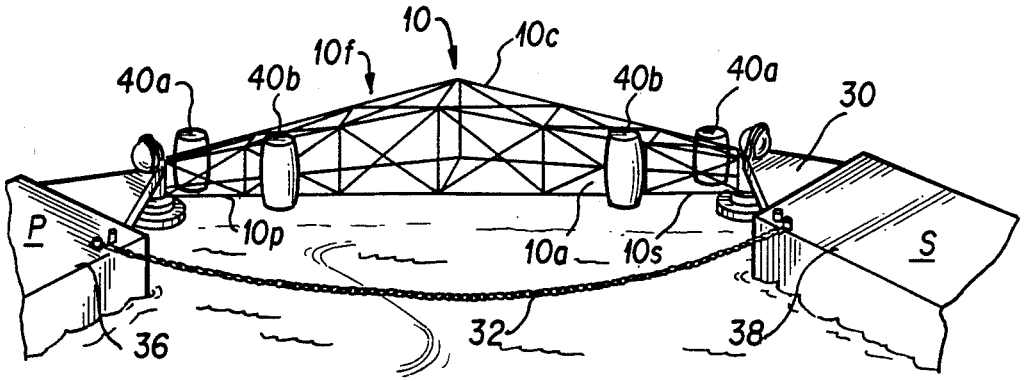
FIG. 1 is a perspective, partly broken view of the barge connection apparatus of the present invention.
Figure 2:
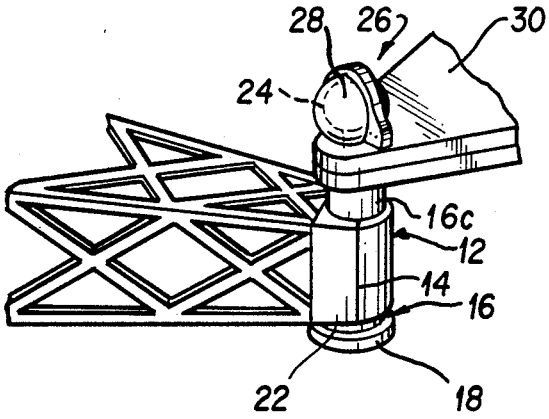
FIG. 2 is an enlarged perspective, partly broken view of the pivot arm connection of the present invention.

Each of pivot arms 16 has a trunion 18 formed on the bottom end 16*a* thereof (FIG. 2). Trunions 18 of pivot arms 16 are composed of a solid polished metal, preferably steel, and are preferably positively lubricated. Interposed between fitting 12 and trunion 18 is a carrier bushing or bearing 22. The carrier bearing 22 rests upon the polished lubricated surface of trunion 18 and bridge girder 10, via its fitting 12, rests upon the carrier bearing 22 to facilitate freedom of rotation of bridge element 10 about pivot arm 16.

The upper end of pivot arm 16 terminates in a ball 24 formed integral with pivot arm shaft 16*c*. Ball 24 is preferably steel covered with a polymeric material such as rubber and comprises one portion, which is the interior portion, of a ball-in-socket connection 26 with the polymeric material disposed between the ball 24 and a socket portion 28 to prevent undue friction in the connection 26.

Figure 10:
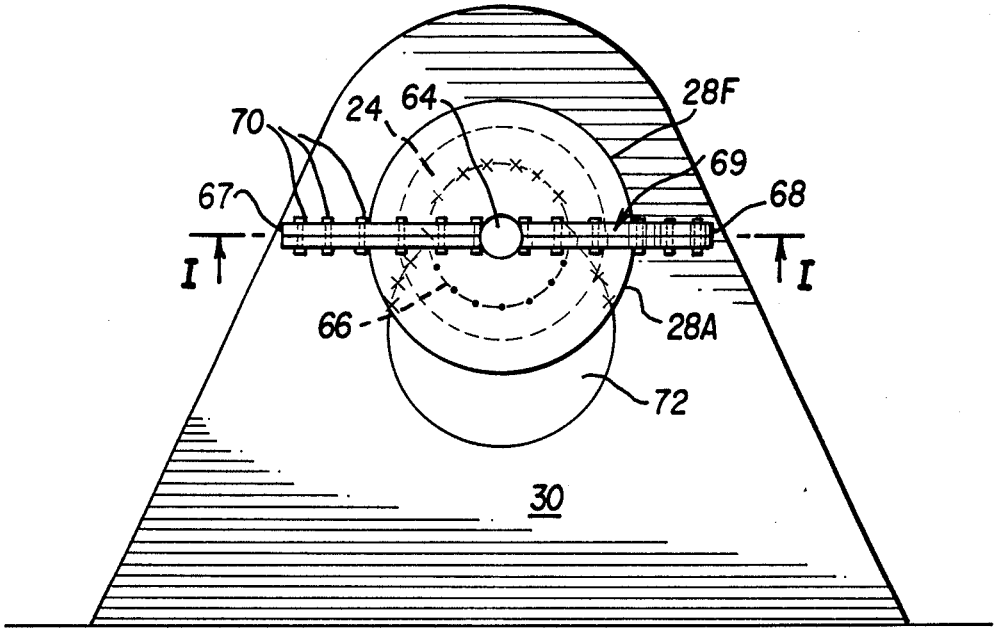
FIG. 10 is a plan view of the barge bow bracket, shown in FIG. 9, with mounted socket.
Figure 11:
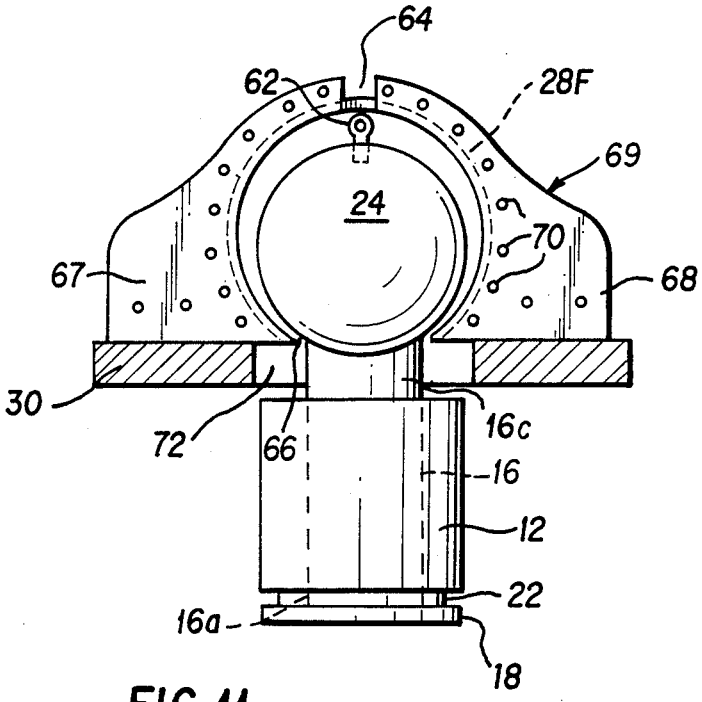
FIG. 11 is a cutaway, sectional view of the pivot and connection taken along line I—I of FIG. 10.

Socket portion 28 of the ball-in-socket connection 26 is mounted above the small part of a quasi-keyhole shaped opening 72 (FIGS. 10–11) in bow bracket 30 mounted on a barge, or other waterborne vessel, to be used with the apparatus. The socket portion 28 is a split socket having essentially hemispherical socket halves 28F and 28A removably secured by flanges 69 at their abutting edges. Socket half 28F is affixed to bow bracket 30 by welding or other known suitable means. Extending from flanges 69 are mounting brackets 67 and 68 for securing socket half 28A to socket half 28F. Socket halves 28F and 28A are shown being joined by bolt and nut combinations 70. Other means of attachment, known to those skilled in the art, may also be used for joining socket halves 28F and 28A one to the other. At the top of ball 24 is a removable eyelet 62, threadably received in a receptacle 60, used to attach a hoist cable for lifting ball 24 through a hole in bow bracket 30 to a position where socket halves 28F and 28A may be mounted around ball 24 and onto bow bracket 30 to complete ball-in-socket connection 26 between each barge and bridge element 10.

Socket halves 28F and 28A each have an opposing half round channel which together form opening 64 when socket portion 28 is assembled. Opening 64 accommodates the eyelet 62 to which the hoist cable is connected during assembly and disassembly of the ball-in-socket connection 26 and permits the removal and insertion of eyelet 62 as it relates to threaded receptacle 60 of ball 24. Thus, bridge element 10 is adapted freely to rotate upon carrier bearing 22 about pivot shaft 16 in a horizontal plane and pivot shaft 16, supporting bridge element 10, is arranged to rotate freely (within limits) about ball-in-socket connection 26 in a vertical plane. Ball-in-socket connection 26 may optionally be constructed to include material and/or equipments that provides shock-absorbing characteristics, cooling as necessary, and positive lubrication, such as supplying water or other fluid under pressure, to the ball-in-socket contact.

To attach a barge to bridge element 10, ball 24 is placed below the large portion of quasi-keyhole shaped opening 72 in bow bracket 30. A hoist cable is attached to ball 24 by means of eyelet 62. The ball 24 is lifted through the large portion of opening 72 and moved forward so that it is seated in socket half 28F with pivot arm 16 seated in the small portion of opening 72. While ball 24 remains suspended by the hoist cable, socket half 28A is mated to socket half 28F to complete socket portion 28. The formation of socket portion 28 produces opening 66 through which pivot arm 16 passes while ball 24 is retained within socket portion 28. The tension is removed from the hoist cable and eyelet 62 removed from ball 24 thereby completing ball-in-socket connection 26.

Bow bracket 30 is mounted to the bow of a barge, or other water borne vessel, such that socket portion 28 is centrally in alignment with the longitudinal center line of the barge.

Mounted to bridge element 10 adjacent to ends 10*p* and 10*s* are fenders 40*a* and 40*b*. Fenders 40*a* are mounted to the forward, with respect to the normal tow heading, horizontal surface 10*f* of bridge element 10 and fenders 40*b* are mounted to the aft horizontal surface 10*a* of bridge element 10. Fenders 40*b*, protecting the aft vertical face of bridge element 10, are of such a size that they will contact a barge when the bridge element 10 is perpendicular to the longitudinal center line of the barge and prevent the barge sterns from closing to a significantly greater extent than defined by the minimum separation which may occur without undue distortion between the barge bows when bridge element 10 and barges P and S are disposed generally as illustrated in FIG. 5. Fenders 40*a* are of such a size and so mounted that a barge abuts fenders 40*a* when disposed at an obtuse angle with the longitudinal center line of the bridge element as illustrated by the starboard barge S in FIG. 3.

A link chain 32 or other flexible apparatus interconnects the bow portions of barges P and S which are otherwise interconnected by bridge element 10. Chain 32 serves, in combination with fenders 40*a* and 40*b*, to limit the rotation of the barges about the pivot arms 16 in the horizontal plane. The practical result is that chain 32 prevents barges P and S from moving forward of the longitudinal axis of the bridge element 10 at the same time.

In operation, bridge element 10 is arranged to connect a pair of barges, port barge P and starboard barge S. Chain 32 extends from a connection to the inboard part of bow 36 of port barge P to a connection to the inboard part of bow 38 of port barge S. The barges are thus interconnected to form a single dual barge unit while being free to swing with a limited range of movement in a generally horizontal plane about their pivot arms 16 and adapted to pivot freely about ball-in-socket connection 26 in swells.

Figure 6:
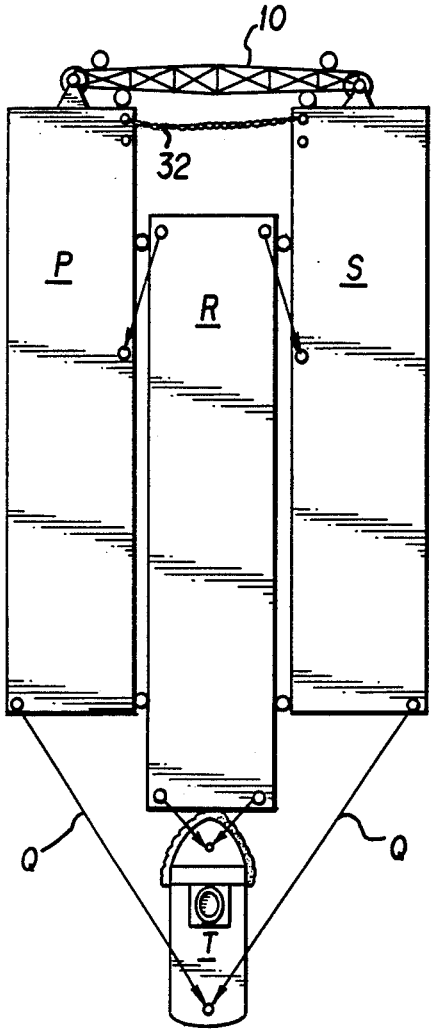
FIG. 6 is a plan view of an alternate multiple barge arrangement of the present invention.

The dual barge arrangement of the present invention may also be employed to provide a multi-barge arrangement as shown in FIG. 6. Here, the dual barge arrangement comprises a port barge P and starboard barge S interconnected by bridge element 10. The bridge element's length is approximately equal to two times the beam of any one of the barges, assuming all are of the same or approximately the same dimensions. A third barge R is interposed between the barges P and S of the dual barge arrangement. A tug T is positioned to push barge R in a manner well known in the art, quartering lines Q are provided from tug T to barges P and S of the dual barge arrangement. Such a multiple barge arrangement is more stable during headway than prior art barge arrangements because the bows of the port and starboard barges P and S are dimensionally stable. Therefore the tow may travel at a greater speed than a tow in which the outside corner barges are disposed in other arrangements known to the art.

Make-up and release is also greatly simplified in a manner similar to that described below with respect to a dual barge/tug arrangement.

Figure 7:
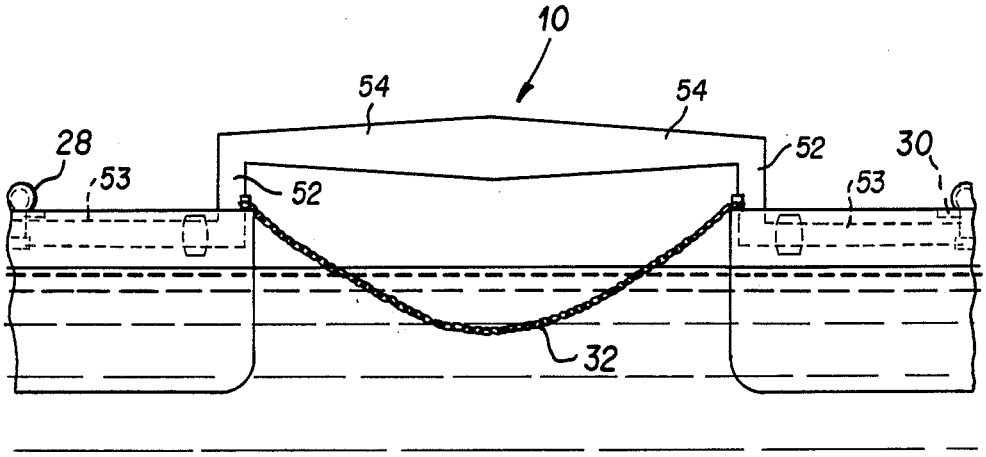
FIG. 7 is an elevational, partly broken view of a further embodiment of the apparatus providing for the connection of barge groups.
Figure 9:
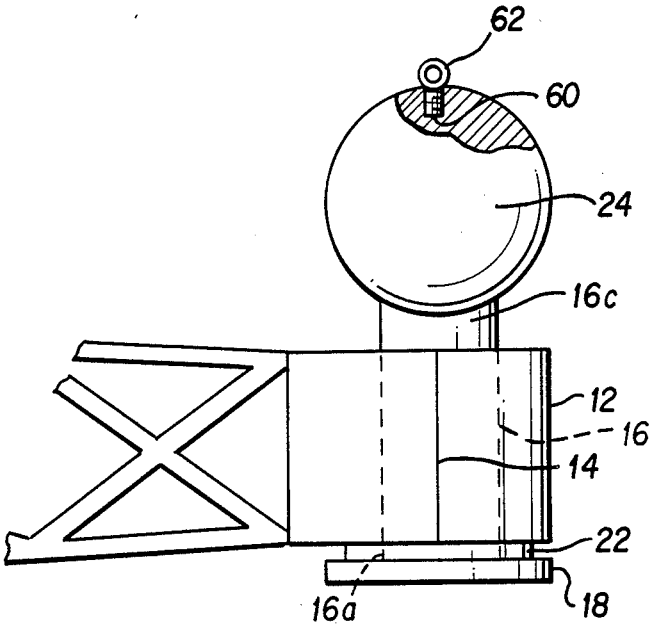
FIG. 9 is an enlarged, elevational view of the end ball portion of the barge connection apparatus.
Figure 8:
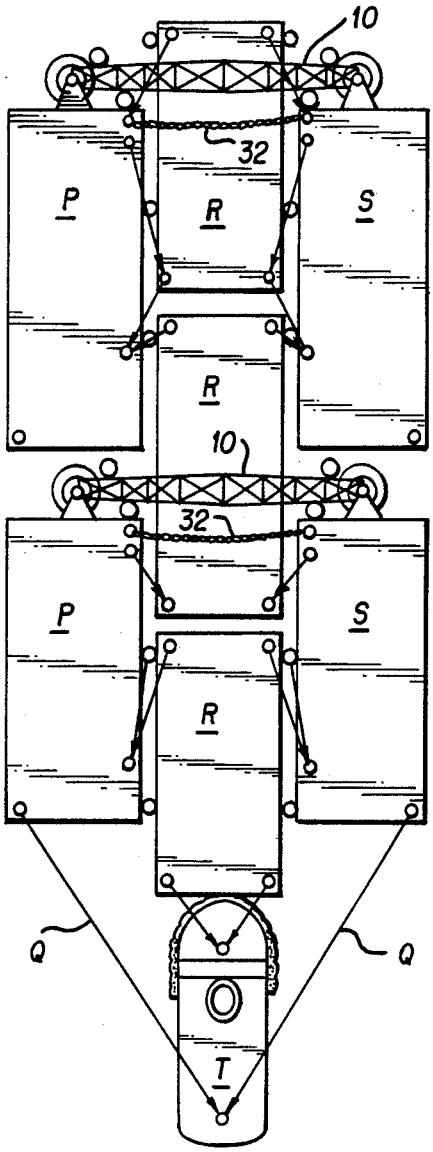
FIG. 8 is a plan view of a multiple tow using the apparatus of FIG. 7.

In assembling a dual barge arrangement, tug T or a dredge first makes up to either barge P or S. Preferably the tug attaches itself to the barge which is oriented aft of the bridge element's longitudinal center line in an on-hip arrangement (FIG. 3). The tug then imposes headway (arrow 48), the drag imposed on the second barge causes it to swing toward the tug (arrow 49) and also causes bridge element 10 to swing toward the hooked up barge until it contacts fender 40*b* (FIG. 4). When the free barge bears against the tug, a breasting line 50 is attached to the barge to complete the desired arrangement. Thus, a dual barge on-hip orientation is provided without limiting the maneuverability of the tug during the assembly process. Such an arrangement is particularly well adapted for dredging operations whereby an ocean going dredge can be used in place of the tug with empty barges serving as receptacles for the dredged material. When the barges are full, the dredge then easily releases the barges by casting off one breast line and backing, which tends to separate the sterns of the barges from each other, and then casting off the second breast line. A tug then easily makes-up with the connected barges to effectuate the dual barge arrangement for transporting the spoils contained therein to a disposal site while the dredge makes-up with a second empty dual barge arrangement to continue dredging operations.

Where it is advantageous to have a large number of barges interconnected, the bridge girder is configured as shown in FIG. 7. In this configuration, bridge element 10 tapers, from the center toward each end, to upright column support 52 which connects bridge girder continuation section 53 to a raised central bridge section 54. Raised central bridge section 54 permits the tri-barge configuration described immediately above to be moved forward and joined to another tri-barge configuration as shown in FIG. 8. By employing multiple bridging girders it is possible to make up a large tow of multiple tri-barge units.

Another use of such a device is to provide a protective barrier for shipping in hazardous shipping lanes. By assembling long barges, attached to a bridging girder as described above, a ship having to navigate waters threatened by hostile activities provides the propulsion means for the dual barge concept, the barges being disposed along the ship's flanks. If filled with appropriate shock absorbing materials, such as water, sand or sited concrete, the barges provide an effective protective armor against low-flying missiles or near-surface running torpedoes. Mounting appropriate radar or communications devices upon these outlying barge systems presents alternative targets for weapon systems that home on electromagnetic transmissions. Upon arrival at port, the barge arrangement is conveniently anchored, and the ship withdrawn therefrom for berthing and loading and/or unloading.

It should be understood that the foregoing description and drawings of the invention are not intended to be limiting, but are exemplary of the intended features which are defined in the claims.

Having disclosed my invention, what I claim and to be secured by Letters Patent of the United States is:

1. An apparatus for attaching waterborne vessels for movement, comprising:

an attachment means mounted forward from the bow of each of said waterborne vessels coincident with the longitudinal centerline of each of said waterborne vessels' hull;

a bridge element;

means for pivotally connecting each end of said bridge element to a corresponding said attachment means mounted on each of said waterborne vessels;

and pivot limiting means for maintaining the attached said waterborne vessels and said bridge element in an appropriate alignment.

2. An apparatus for attaching waterborne vessels for movement, comprising:

an attachment means mounted on the bow of each of two waterborne vessels, said attachment means extending from the bow of each said waterborne vessel coincident with the longitudinal center line of the vessel hull and having a socket on the forward end thereof;

a bridge element, said bridge element having a ball at each end for pivotally connecting to said socket of said attachment means mounted on each of two said waterborne vessels;

and pivot limiting means for maintaining the attached said two waterborne vessels and said bridge element in an appropriate alignment.

3. The apparatus of claim 2, wherein said socket further comprises two flanged halves provided with means for joining said halves.

4. The apparatus of claim 2, wherein the said bridge element comprises two conical sections joined at their bases.

5. The apparatus of claim 2, wherein said bridge element comprises a reinforced girder structure tapered from its center toward each end.

6. The apparatus of claim 2, wherein said pivot limiting means prevents movement of said waterborne vessels toward each other past a parallel arrangement.

7. The apparatus of claim 2, further comprising a chain connected to the inboard bow of said waterborne vessels to limit movement of said waterborne vessels away from each other.

8. The apparatus of claim 2, wherein a powered waterborne vessel positioned between the waterborne vessels attached to said bridge element to provide means for producing movement.

9. The apparatus of claim 2, wherein said bridge element further comprises:

a center section;

a downward descending linking section attached at each end of said center section; and an end section attached at the bottom of each said downward descending linking section, said end sections extending parallel to a center line of said center section and away from said center section.

10. The apparatus of claim 2, further comprising a third waterborne vessel, said third waterborne vessel positioned between and tied to the attached said two waterborne vessels, and is pushed by a powered waterborne vessel to produce movement.

11. An apparatus for creating a dual barge combination comprising:

a socket connection attached to and extending from the bow of a first barge oriented along the longitudinal center line of the first barge;

a socket connection attached to and extending from the bow of a second barge along the longitudinal center line of the second barge;

a first and second pivot arm, said pivot arms terminating in a ball adapted to be received by said first and second sockets;

a bridge element extending from a pivotal connection to said first pivot arm to a pivotal connection to said second pivot arm; and pivot limiting means on said bridge element.

12. An apparatus as claimed in claim 11, wherein said bridge element comprises a pair of cones joined at their bases.

13. An apparatus as claimed in claim 11, wherein said bridge element comprises a boxed girder structure tapered from its center toward both ends.

14. An apparatus as claimed in claim 11, wherein said bridge element further comprises:

a center section;

a downward descending linking section attached at each end of said center section; and an end section attached at the bottom of each said downward descending linking section, said end sections extending parallel to a center-line passing through the longitudinal axis of said center section and away from said center section.

15. The apparatus claimed in claim 11, wherein said pivot limiting means includes fenders mounted to said bridge element to limit movement of the first barge towards the second barge past a parallel arrangement.

16. The apparatus claimed in claim 11, wherein said pivot limiting means further includes a chain extending from the inboard bow of the first barge to the inboard bow of the second barge to limit movement of the barges away from each other.

17. The apparatus claimed in claim 11, further comprising motivating means, said motivating means being a powered waterborne vessel.

18. An apparatus for releasably interconnecting two waterborne vessels which comprises:

a socket attached at the bow of each waterborne vessel coincident with the vertical center line of the waterborne vessel;

a substantially linear bridge element, said bridge element including fenders to limit movement of said waterborne vessels toward each other past a substantially parallel orientation;

a pivot arm vertically removably mounted in each end of said bridge element such that said bridge element can pivot about said pivot arm and including a ball on the upper end thereof, said ball being seated in said socket so as to form a ball-in-socket linkage; and a chain interconnecting said waterborne vessels to limit movement of said waterborne vessels away from each other.

19. An apparatus as claimed in claim 18, wherein said socket further comprises two flanged halves provided with means for joining said halves.

20. The apparatus of claim 18, wherein said bridge element comprises two cones joined at the bases.

21. The apparatus of claim 18, wherein said bridge element comprises a box girder structure tapered from the center toward each end.

22. The apparatus of claim 18, wherein a motivating means comprises a powered waterborne vessel.

23. The apparatus of claim 18, wherein said bridge element further comprises:

a center section;

a downward descending linking section attached at each end of said center section; and an end section attached at the bottom of each said downward descending linking section, said end sections extending parallel to a center-line passing through the longitudinal axis of said center section and away from said center section.

* * * * *